US006959701B2

(12) United States Patent
Zimmermann et al.

(10) Patent No.: US 6,959,701 B2
(45) Date of Patent: Nov. 1, 2005

(54) CONNECTING PIECE

(75) Inventors: Helmut Zimmermann, Hösslinswart (DE); Michael Joos, Fellbach (DE); Andreas Radtke, Bad Cannstatt (DE); Stefan Leuze, Remshalden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 139 days.

(21) Appl. No.: 10/396,813

(22) Filed: Mar. 26, 2003

(65) Prior Publication Data

US 2003/0183213 A1 Oct. 2, 2003

(30) Foreign Application Priority Data

Mar. 26, 2002 (DE) ..... 102 13 413

(51) Int. Cl.[7] ..... F02M 29/00
(52) U.S. Cl. ..... 123/590; 123/184.22
(58) Field of Search ..... 123/590, 184.46, 123/184.22, 184.23, 184.24, 184.25, 184.26, 184.27

(56) References Cited

U.S. PATENT DOCUMENTS 4,711,225 A 12/1987 Holderle et al.
4,712,523 A * 12/1987 Matsubayashi ..... 123/188.14
6,439,482 B2 * 8/2002 Hosoyama et al. ..... 239/463

* cited by examiner

*Primary Examiner*—Thomas Denion
*Assistant Examiner*—Zelalem Eshete
(74) *Attorney, Agent, or Firm*—Walter Ottesen

(57) ABSTRACT

A connecting piece (1) between a carburetor (4) and an inlet channel (3) is disposed in an internal combustion engine (2) of a portable handheld motor-driven work apparatus such as a motor-driven chain saw, cutoff machine, et cetera. The connecting piece (1) serves to compensate for relative position changes between the engine (2) and the carburetor (4). The connecting piece (1) is made of elastic material and has an expansion fold (5) which functions to compensate for length changes. The length of the connecting piece can be changed from a pressed length (a) to an expanded length (b). The expansion fold (5) partitions the connecting piece (1) into a carburetor-end section (6) and into an engine-end section (7). The carburetor-end section (6) includes a circularly-shaped flow cross section and the engine-end section (7) includes a circularly-shaped flow cross section at the side facing toward the expansion fold (5) and has a flow cross section which departs from the circular shape at the end facing toward the engine. The connecting piece (1) includes on the inner side grooves (24) which run in the longitudinal direction.

14 Claims, 4 Drawing Sheets

Fig. 4
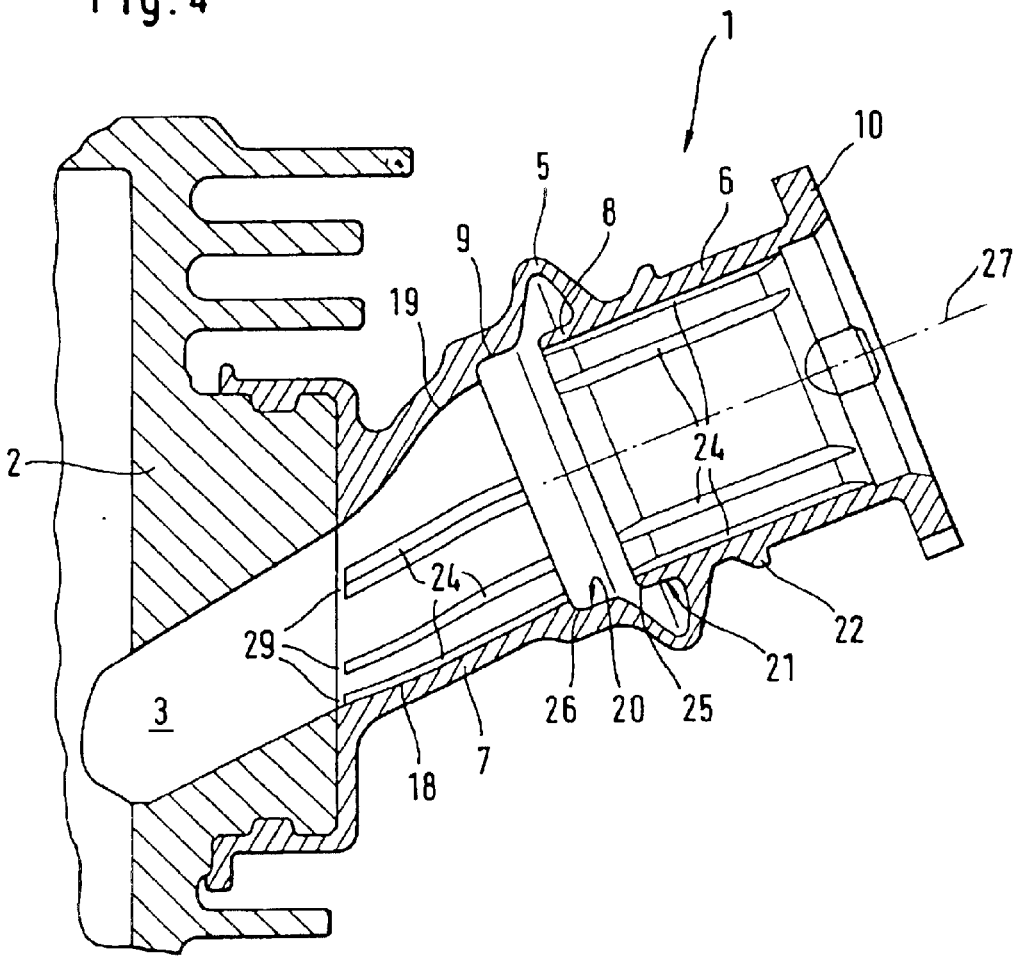
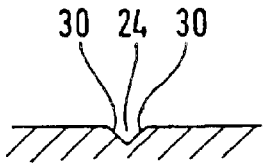
Fig. 5
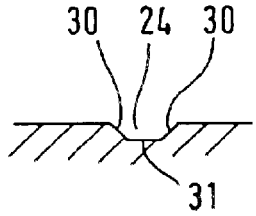
Fig. 6

CONNECTING PIECE

BACKGROUND OF THE INVENTION

In the operation of internal combustion engines, the air/fuel mixture flows through the connecting piece from the carburetor to the combustion chamber. A portion of the fuel, especially long-chain hydrocarbons, deposits on the inner wall of the connecting piece and forms a fuel film. An enrichment of the mixture can occur when pivoting the apparatus especially in idle because of fuel which is entrained from the connecting piece. A sudden mixture enrichment can lead to disturbances in the smooth running of the engine up to stalling thereof. This is especially the case for engines having low power-weight ratio.

U.S. Pat. No. 4,711,225 discloses a connecting piece between carburetor and combustion chamber which is made of elastic material and has expansion folds. Knurling is provided in one region of the connecting piece to avoid that fuel deposits on the inner wall of the connecting piece. The knurling is intended to prevent the formation of an uninterrupted fuel film.

It has been shown that the fuel, which deposits in the connecting piece, forms droplets especially in the region of the smooth wall and these droplets only flow to the engine when they have reached a certain size. The internal combustion engine suddenly receives too much fuel because of the droplet formation.

SUMMARY OF THE INVENTION

It is an object of the invention to provide a connecting piece of the kind described above which conducts fuel, which collects in the connecting piece, continuously to the combustion chamber.

The connecting piece of the invention is for connecting a carburetor to an inlet channel of an internal combustion engine of a portable handheld motor-driven work apparatus. The connecting piece includes: an annular conduit-like member made of elastic material and defining a longitudinal direction; the conduit-like member having an inner side and having an expansion fold subdividing the conduit-like member into a carburetor-end section and an engine-end section; the carburetor-end section having a circular flow cross section and the engine-end section having a first end facing toward the expansion fold and a second end facing toward the engine; the engine-end section having a circular cross section at the first end and a flow cross section at the second end which departs from the circular cross section at the first end; and, a plurality of grooves running in the longitudinal direction on the inner side surface of the conduit-like member.

The grooves, which run in the longitudinal direction of the connecting piece, facilitate the removal of fuel from the connecting piece and so prevent an uncontrolled droplet formation. It has been shown that the grooves, which run in the longitudinal direction of the connecting piece, lead to an increase of the stability of the connecting piece against underpressure. The side walls between the grooves become arcuate in the presence of underpressure in the interior of the connecting piece and mutually support each other in the region of the grooves. In this way, a complete collapse of the connecting piece is avoided as is the case where the interior walls are configured to be smooth.

The grooves are provided to have inclined side walls. In this way, the inflow of fuel into the grooves is facilitated on the one hand and the function of the groove as a desired break location with the application of underpressure is improved. The grooves especially have a base region running approximately parallel to the inner wall of the connecting piece. The trough-shaped configuration of the grooves facilitates the flow-off of fuel. It can be practical that the grooves have a V-shaped cross section.

At least one groove runs along the entire length of a section especially over the length of the engine-end section of the connecting piece. It is practical to arrange at least one groove in a lower region of the connecting piece which extends over approximately the entire length of the connecting piece. The removal of fuel from the connecting piece is facilitated by the extension of the longitudinal grooves over a wide region of the connecting piece.

The lower region of the connecting piece has a straight-line course, especially approximately parallel to the symmetry axis in the carburetor-end section in the built-in position of the connecting piece. The removal of fuel is facilitated by the straight-line course of the lower region. Especially when removing a connecting piece manufactured in an injection-molding process, lateral tears of the connecting piece can occur in the region of the elliptic connecting area at the inlet channel. This is so because a notched location is formed here because of the grooves. To reduce the notching action of the grooves, it can be provided that the grooves (especially the lateral grooves) are filled in a small region in the region of the connection to the inlet channel. This provides a smooth contour of the cross section. It can be provided that the connecting piece has a seal lip and a seal seat in the region of the expansion fold. For a collapsed length of the expansion fold, the seal lip comes into contact engagement in the seal seat and closes this seal seat substantially fluid tight. The seal lip closes the expansion fold in the collapsed and slightly expanded state of the connecting piece so that, especially in the grooves, conveyed fuel in the carburetor-end section cannot collect in the expansion folds; rather, this fuel flows off into the engine-end section. The flow-off is also facilitated in that the sealing lip and the bounding engine-end section have the same inner diameter. The grooves, which run in the carburetor-end section, are continued to the seal lip in order to facilitate the flowoff of fuel via the expansion fold.

It is practical that the connecting piece has a connecting flange at the end of the carburetor-end section. No grooves are provided in the connecting piece in the region of the connecting flange. The risk of collecting fuel is slight in the upper region of the connecting piece directly after the carburetor. The smooth configuration of the inner wall in the region of the connecting flange prevents a collection of fuel.

A seal collar is mounted at the engine side end of the connecting piece in order to increase the stability of the connecting piece. A thickening is arranged at an upper region of the connecting piece at the transition from the engine end section into the seal collar.

BRIEF DESCRIPTION OF THE DRAWINGS

The invention will now be described with reference to the drawings wherein:

FIG. 4 is an enlarged detail view of the connecting piece of FIG. 3;

FIG. 5 is a section view through a V-shaped groove; and,

FIG. 6 is a section view through a trapezoidally-shaped groove.

DESCRIPTION OF THE PREFERRED EMBODIMENTS OF THE INVENTION

Figure 1:
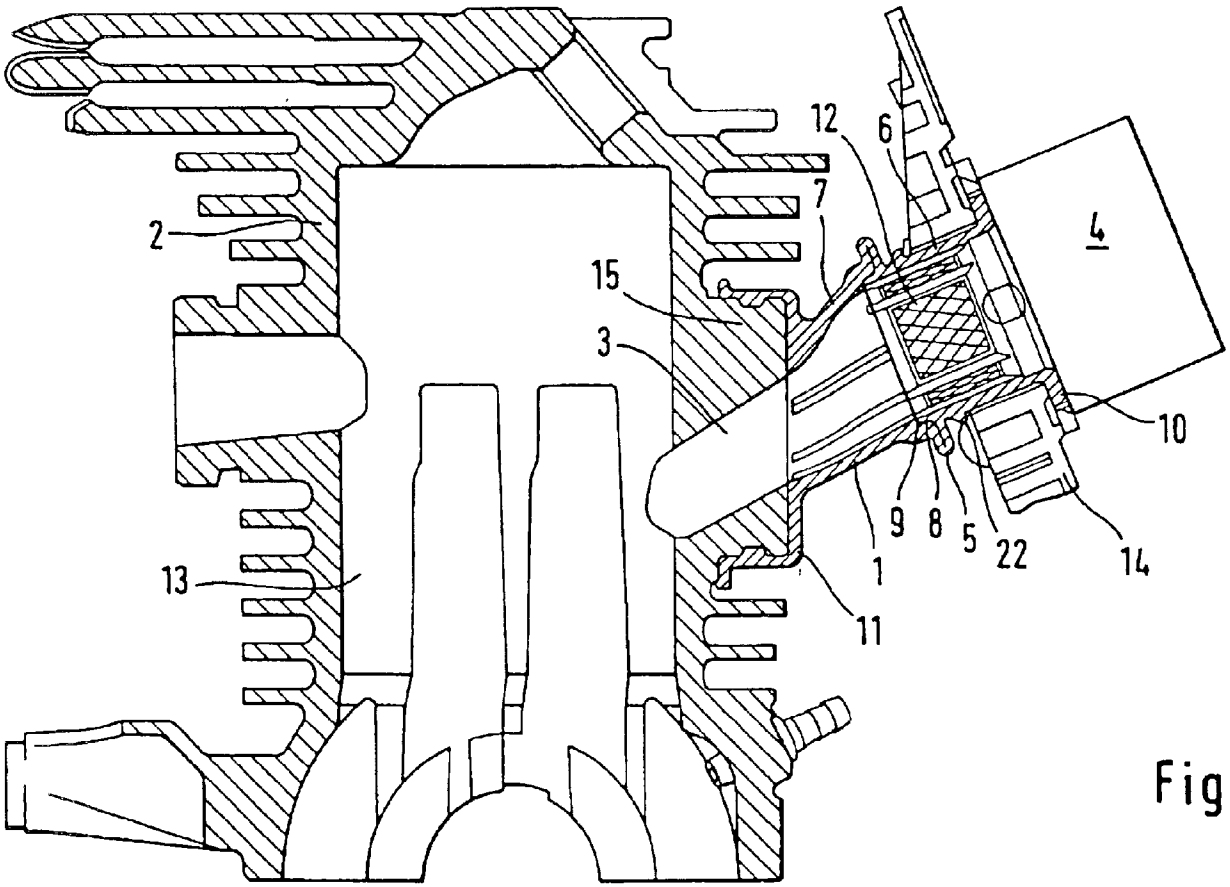
FIG. 1 is a section view through a cylinder of a two-stroke engine having a connecting piece arranged on the intake stub with the connecting piece shown in the pressed state with a carburetor also being indicated schematically.
Figure 2:
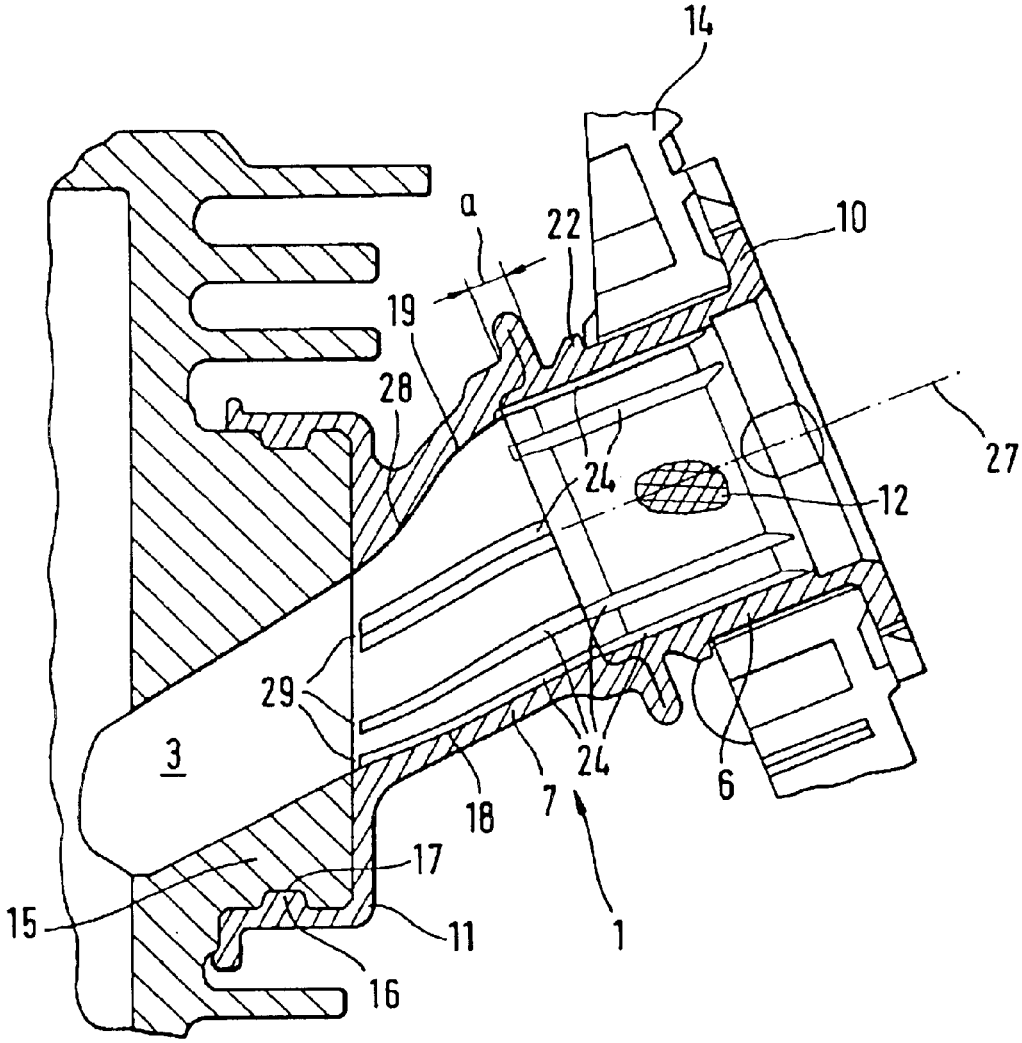
FIG. 2 is an enlarged detail view of the connecting piece of FIG. 1.

FIG. 1 shows an internal combustion engine 2 which is configured as a two-stroke engine. An inlet channel 3 opens into the cylinder 13 of the engine 2 and conducts an air/fuel mixture to the engine which is prepared in a schematically-illustrated carburetor 4 and is conducted to the inlet channel 3 via a connecting piece 1. The carburetor 4 is fixed to a housing part 14 which is movably supported relative to the engine 2. The connecting piece 1 is made of elastic material and serves to compensate the relative position changes between carburetor 4 and engine 2. For this purpose, the connecting piece 1 has an expansion fold 5 whose length is variable between the collapsed or pushed together length (a), which is shown in FIG. 2, up to the expanded length (b) shown in FIG. 3. The expansion fold 5 subdivides the connecting piece 1 into a carburetor-end section 6 and an engine-end section 7. The carburetor-end section 6 has a circularly-shaped flow cross section; whereas, in the engine-end section 7, the cross-sectional form passes from a circular shape at the expansion fold 5 to an approximately elliptical form at the interface to the inlet channel 3. The lower region 18 of the connecting piece 1 is shown in FIG. 2 and extends over the entire length of the connecting piece 1 approximately as a straight line and approximately parallel to the symmetry axis 27 of the carburetor-end section 6. The change of the cross-sectional shape is achieved with a curved or arched portion 28 in the upper region 19 in the interior of the connecting piece 1. The cross-sectional area in the interior of the connecting piece 1 is constant over the entire length of the connecting piece 1. However, it can be advantageous that the cross-sectional area is varied over the length of the connecting piece 1.

The expansion fold 5 is configured as a V-shaped bead directed outwardly. The connecting piece 1 includes a seal lip 8 which is provided on the carburetor-end section 6 and is an extension of the carburetor-end section 6 in the direction toward the engine-end section 7. In FIG. 4. the expansion fold 5 is shown enlarged in the expanded position. A seal seat 9 is provided on the engine-end section 7 which is configured as an annularly-shaped step which runs in a section 20 parallel to the inner contour of the connecting piece 1. The seal lip 8 includes a section 21 configured likewise parallel to the inner contour which coacts with the section 20 of the seal seat 9 and closes off the expansion fold 5 seal-tight when the sections 20 and 21 overlap in the direction of the symmetry axis 27 as shown in FIG. 2. For a slightly expanded expansion fold 5, the seal seat 9 is no longer completely covered by the seal lip 8 so that the flow cross section La slightly increased but the expansion fold 5 is still closed. The expansion fold 5 is a significantly larger obstacle for a fuel drop.

The outer diameter of the seal lip 8 is greater than the inner diameter of the seal seat 9 so that a good seal is achieved. To avoid a clamping of the seal lip 8 at the seal seat 9 when collapsing the expansion fold 5, the seal lip 8 is configured to be rounded at its forward edge 25 as shown in FIG. 4. The seal seat 9 includes a corresponding rounding 26 in order to make possible a complete coverage of the seal seat 9 by the seal lip 8.

In the built-in state, the expansion fold 5 is collapsed or pressed and closed off in the seal seat 9 by the seal lip 8 as shown in FIGS. 1 and 2. The seal lip 8 and the bounding engine-end section 7 of the connecting piece 1 have the same inner diameter so that here no fuel droplets collect; rather, these droplets can flow to the engine-end section 7 with a slightly open gap between engine-end section 7 and carburetor-end section 6. The connecting piece 1 is fixed between the housing part 14 and the carburetor 4 by the connecting flange 10. The flow cross section in the carburetor 4 passes over approximately seamlessly into the cross section of the connecting piece 1.

Grooves 24 are provided in the longitudinal direction of the connecting piece 1. No grooves 24 are provided in the region of the connecting flange 10. These grooves begin below the connecting flange 10 and continue in the longitudinal direction of the connecting piece 1. In this region, a thin-walled sleeve (for example, a thin-walled sleeve made of steel) can be used in order to avoid a snapping in or buckling of the connecting piece 1 in the region of the connecting flange 10. As shown in FIG. 2, a total of five grooves 24 are arranged laterally of each other in the connecting piece 1. These grooves extend from the carburetor-end section 6 over the seal lip 8 and the engine-end section 7 up to the connecting area at the inlet channel 3. Three grooves 24 are arranged in the lower region 18. The lower groove 24 also runs approximately in a straight line because of the straight-line course in the lower region 18. In a narrow region 29 ahead of the connecting area, the grooves 24 are filled in order to provide no weakening of the cross section in the region of the connecting area especially at the lateral running grooves 24 and thereby reduce the danger of tearing especially during manufacture. Lateral grooves 24 are arranged in the engine-end section 7 which do not continue to the carburetor-end section 6; whereas, grooves 24 are arranged in the upper region 19 only in the carburetor-end section 6. The grooves 24 have a V-shaped cross section as shown in FIG. 5. The grooves 24 can also have inclined side walls 30 and a base region 31 running parallel to the inner contour as shown in FIG. 6.

The carburetor-end section 6 includes knurling 12 at its inner surface. The knurling 12 can also be provided in the engine-end section 7; however, here, the manufacturing is more complex because of the approximately elliptical shape and the knurling is not necessary in the engine-end section 7 for the function of storing fuel. Fuel which exits from the knurling 12 flows directly into the grooves 24 because of the arrangement of the grooves 24 in the carburetor-end section 6 and is so guided to the engine 2.

The connecting piece 1 is fixed with a seal collar 11 on the inlet channel 3 and the seal collar 11 engages around the intake stub 15. An edge 16 provided on the seal collar 11 engages in a slot 17 arranged on the intake stub 15 for axial fixation. The approximately elliptical connecting area of the connecting piece 1 passes seamlessly into the cross-sectional area of the inlet channel 3.

Figure 3:
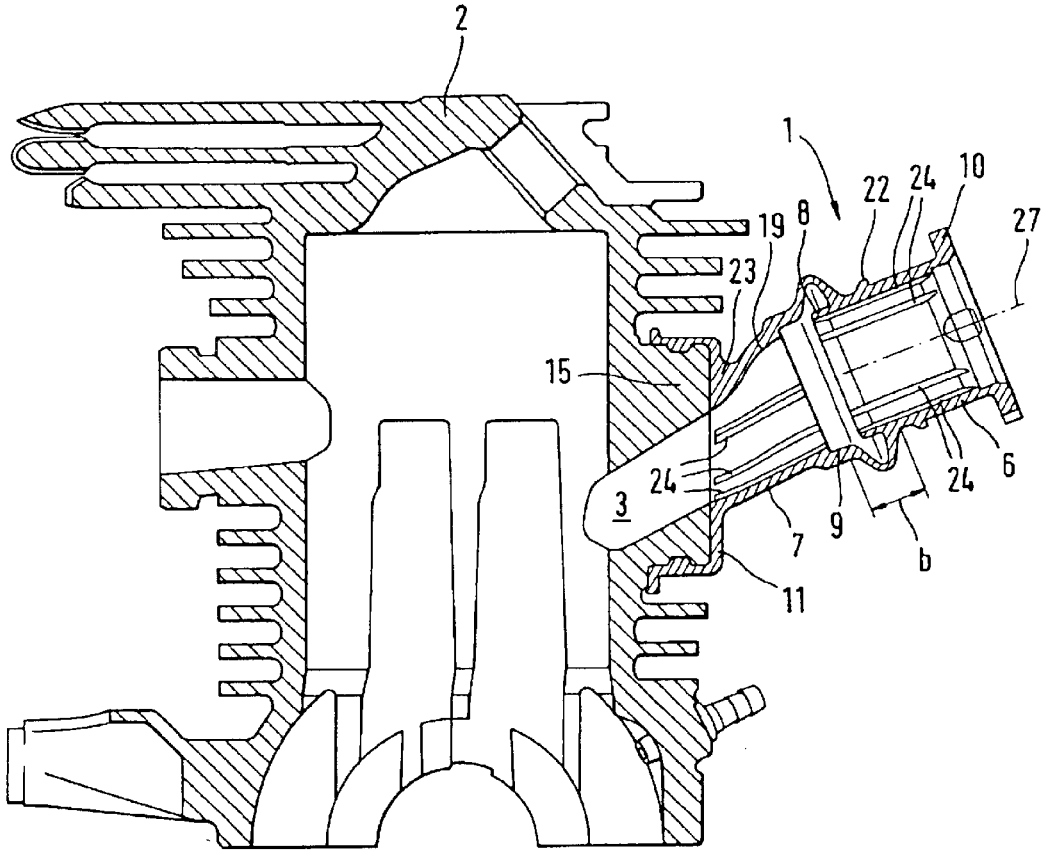
FIG. 3 is a section through a cylinder of a two-stroke engine having a connecting piece with expanded expansion fold and with the connecting piece mounted on the intake stub.

In order to prevent a collapse or buckling of the connecting piece 1 under intense mechanical load, a thickening 23 is provided in the upper region 19 at the transition of the engine-end section 7 into the seal collar 11 as shown in FIG. 3.

An edge 22 is arranged on the outer contour of the carburetor-end section 6 and functions to tightly clamp the connecting piece 1 behind the housing part 14 in the pressed state during assembly as shown in FIGS. 1 and 2. In the event that the connecting piece 1 is pressed during operation and starting from the built-in position, this pressing is compensated not by the expansion fold 5 but by the elasticity of the material of the connecting piece 1.

It is understood that the foregoing description is that of the preferred embodiments of the invention and that various changes and modifications may be made thereto without departing from the spirit and scope of the invention as defined in the appended claims.

What is claimed is:

1. A connecting piece for connecting a carburetor to an inlet channel of an internal combustion engine of a portable handheld motor-driven work apparatus, said connecting piece comprising:

an annular conduit-like member made of elastic material and defining a longitudinal direction;

said conduit-like member having an inner side and having an expansion fold subdividing said conduit-like member into a carburetor-end section and an engine-end section;

said carburetor-end section having a circular flow cross section and said engine-end section having a first end facing toward said expansion fold and a second end facing toward said engine;

said engine-end section having a circular flow cross section at said first end and a flow cross section at said second end which departs from said circular flow cross section at said first end;

a plurality of grooves running in said longitudinal direction on said inner side of said conduit-like member; and, at least one of said plurality of grooves extending uninterruptedly along the entire length of one of said sections so as to facilitate a continuous removal of fuel and reduce an uncontrolled droplet formation.

2. The connecting piece of claim 1, wherein said grooves have inclined side walls.

3. The connecting piece of claim 2, wherein said grooves each have a base region running parallel to said inner side of said conduit-like member.

4. The connecting piece of claim 2, wherein said grooves have a V-shaped cross section.

5. The connecting piece of claim 1, wherein at least one of said grooves runs over the entire length of said engine-end section.

6. The connecting piece of claim 1, wherein at least one of said grooves is disposed in the lower region of said conduit-like member and said one groove extends over approximately the entire length of said conduit-like member.

7. The connecting piece of claim 1, wherein said conduit-like member has a lower region which defines a straight-line course when said connecting piece is built into said work apparatus.

8. The connecting piece of claim 7, wherein said carburetor-end section defines an axis of symmetry; and, said lower region runs approximately parallel to said axis in said carburetor-end section.

9. A connecting piece for connecting a carburetor to an inlet channel of an internal combustion engine of a portable handheld motor-driven work apparatus, said connecting piece comprising:

an annular conduit-like member made of elastic material and defining a longitudinal direction;

said conduit-like member having an inner side and having an expansion fold subdividing said conduit-like member into a carburetor-end section and an engine-end section;

said carburetor-end section having a circular flow cross section and said engine-end section having a first end facing toward said expansion fold and a second end facing toward said engine;

said engine-end section having a circular flow cross section at said first end and a flow cross section at said second end which departs from said circular flow cross section at said first end;

a plurality of grooves running in said longitudinal direction on said inner side of said conduit-like member; and, wherein said engine has an inlet channel; said grooves are filled-in a narrow region at the end of said conduit-like member where said connecting piece is connected to said inlet channel; and, said conduit-like member has a smooth contour on the inside thereof at said narrow region.

10. A connecting piece for connecting a carburetor to an inlet channel of an internal combustion engine of a portable handheld motor-driven work apparatus, said connecting piece comprising:

an annular conduit-like member made of elastic material and defining a longitudinal direction;

said conduit-like member having an inner side and having an expansion fold subdividing said conduit like member into a carburetor-end section and an engine-end section;

said carburetor-end section having a circular flow cross section and said engine-end section having a first end facing toward said expansion fold and a second end facing toward said engine;

said engine-end section having a circular flow cross section at said first end and a flow cross section at said second end which departs from said circular flow cross section at said first end;

a plurality of grooves running in said longitudinal direction on said inner side of said conduit-like member; and, wherein a portion of said grooves are laterally-disposed grooves and said laterally-disposed grooves are filled-in a narrow region at the end of said conduit-like member where said connecting piece is connected to said inlet channel; and, said conduit-like member has a smooth contour on the inside thereof at said narrow region.

11. The connecting piece of claim 1, wherein said conduit-like member has a seal lip in the region of said expansion fold and a seal seat; said expansion fold is foldable between an open position and a closed position corresponding to a pressed length (a) of said expansion fold wherein said seal lip is in contact engagement with said seal seat so as to substantially close the seal fluid tight.

12. The connecting piece of claim 11, wherein the grooves in said carburetor-end section extend on said seal lip.

13. The connecting piece of claim 1, wherein said conduit-like member has a connecting flange on said carburetor-end section; and, said connecting flange is devoid of said grooves.

14. The connecting piece of claim 1, wherein said conduit-like member has a seal collar arranged on said engine-end section on the end thereof facing toward said engine; and, said conduit-like member has a thickening at an upper region thereof in the transition region from said engine-end section to said seal collar.

* * * * *

UNITED STATES PATENT AND TRADEMARK OFFICE

CERTIFICATE OF CORRECTION

PATENT NO. : 6,959,701 B2
DATED : November 1, 2005
INVENTOR(S) : Helmut Zimmermann et al.

It is certified that error appears in the above-identified patent and that said Letters Patent is hereby corrected as shown below:

Column 3,
Line 57, delete “La” and substitute -- is --.

Column 6,
Lines 13 and 42, insert -- in -- after “filled-in”.
Line 26, delete “conduit like” and substitute -- conduit-like --.

Signed and Sealed this

Twenty-eighth Day of February, 2006

JON W. DUDAS
*Director of the United States Patent and Trademark Office*